US007617636B1

(12) United States Patent
Armstrong

(10) Patent No.: US 7,617,636 B1
(45) Date of Patent: Nov. 17, 2009

(54) SPLASHGUARD SYSTEM AND METHOD OF INSTALLATION FOR A SCREENED AREA

(76) Inventor: James E. Armstrong, 901 Belfast Pl., Chuluota, FL (US) 32766

( * ) Notice: Subject to any disclaimer, the term of this patent is extended or adjusted under 35 U.S.C. 154(b) by 574 days.

(21) Appl. No.: 11/549,986

(22) Filed: Oct. 17, 2006

Related U.S. Application Data

(60) Provisional application No. 60/727,544, filed on Oct. 17, 2005.

(51) Int. Cl.
*E04D 13/00* (2006.01)

(52) U.S. Cl. ..... 52/13; 52/11; 52/63; 52/97

(58) Field of Classification Search ..... 52/11, 52/12, 13, 63, 97, 222, 273, DIG. 17; D25/112
See application file for complete search history.

(56) References Cited

U.S. PATENT DOCUMENTS

| | | | | |
|---|---|---|---|---|
| 1,986,383 | A | 1/1935 | Usinger | |
| 2,899,916 | A | 8/1959 | Ertman | |
| 2,983,079 | A * | 5/1961 | Dunn | 52/11 |
| 2,989,822 | A * | 6/1961 | Dunn | 52/91.1 |
| 3,143,165 | A * | 8/1964 | Lewis et al. | 160/394 |
| 3,911,632 | A * | 10/1975 | Bryfogle et al. | 52/13 |
| 4,261,143 | A * | 4/1981 | Rizzo | 52/16 |
| 4,275,532 | A * | 6/1981 | Watson | 52/15 |
| 4,987,717 | A * | 1/1991 | Dameron, Jr. | 52/844 |
| 5,038,530 | A | 8/1991 | Watkins | |
| 5,090,164 | A * | 2/1992 | Mische | 52/90.1 |
| 5,417,015 | A * | 5/1995 | Coyne | 52/11 |
| 5,566,513 | A | 10/1996 | Herren | |
| 5,832,683 | A | 11/1998 | Ito et al. | |
| 6,314,685 | B1 | 11/2001 | Sullivan | |
| 6,427,388 | B1 | 8/2002 | Brochu | |
| 2002/0157323 | A1 * | 10/2002 | Hallsten | 52/3 |
| 2004/0187394 | A1 | 9/2004 | Brochu | |
| 2005/0115160 | A1 | 6/2005 | Brochu | |
| 2006/0090404 | A1 * | 5/2006 | Lovell | 52/97 |
| 2007/0119104 | A1 * | 5/2007 | Pijanowski | 52/11 |

* cited by examiner

*Primary Examiner*—Brian E Glessner
(74) *Attorney, Agent, or Firm*—Allen, Dyer, Doppelt, Milbrath & Gilchrist, P.A.

(57) ABSTRACT

A gutter for collecting water from a roof includes a flange having a channel extending along a top edge of the gutter front side. A gutter bracket is positioned entirely within the gutter trough with one end of the gutter bracket and a rear side of the gutter secured to the fascia of a building. An opposing end of the gutter bracket and the front side of the gutter are commonly secured to a screened room frame. A splashguard extends along the front side of the gutter and includes a bottom flange and a rib mating with the channel of the gutter with the flanges fastened together. A splashguard top edge flange has a channel for receiving a spline securing the screening to the splashguard. A splashguard bracket is secured between an upper portion of the splashguard and the gutter bracket.

28 Claims, 3 Drawing Sheets

SPLASHGUARD SYSTEM AND METHOD OF INSTALLATION FOR A SCREENED AREA

CROSS REFERENCE TO RELATED APPLICATION

This application claims priority to application Ser. No. 60/727,544 for "Pool Enclosure Splash Guard System and Method" having filing date Oct. 17, 2005 and being commonly owned, the disclosure of which is herein incorporated by reference in its entirety.

FIELD OF THE INVENTION

The present invention generally relates to the field of building gutters and splash shields, and more particularly, to a splashguard system and method for deflecting water from a building roof and away from a screened area adjacent the building.

BACKGROUND OF THE INVENTION

Screened rooms such as those used for swimming pool enclosures are well known. As is further well known in the art, while adequately securing the framing of the enclosure can be accomplished, it is often not without excess framing that is time consuming to install and not necessarily pleasing to view. As illustrated by way of example with reference to U.S. Pat. No. 3,143,165 to Lewis et al, method have been developed to attach the frame to a gutter and typically include the need for upright supports extending to the ground from the gutter area and often the gutter itself. As further described in U.S. Pat. No. 5,832,683 to Ito et al, a framed enclosure typically includes a roof unit and wall units attachable to both the roof unit and to a foundation, with the roof unit alternatively attachable to the gutter of a host structure.

While there is a need to attach the framed enclosure to the host structure, and while it is often attempted using the gutter as a convenient means for attachment, there remains a need to effectively use the gutter. There further is a need to prevent water flowing from the roof of the host structure from splashing into the framed enclosure. The present invention is directed to satisfying such needs.

SUMMARY OF THE INVENTION

The present invention is directed to a splashguard system useful for screened enclosures, provides structural support to a gutter attached to a building fascia, and provides ease in attaching a screen material while preventing rain water rushing down a roof from splashing into the associated screened room area.

A roof gutter and framed screen enclosure system may comprise a gutter positioned for collecting water flowing from a roof surface. The gutter may be described as including a bottom and opposing front and rear sides extending upwardly from the bottom to top edges thereof thus forming a trough. The top edge of the front side may include a top flange extending therealong. The top flange may include a channel. A gutter bracket may be positioned entirely within the trough. The gutter bracket may be described as including an arm member having opposing first and second ends, the first end having a first flange coupled to the rear side of the gutter, wherein the rear side of the gutter and the first flange may be secured in combination to a support structure, such as a fascia. The second end may include a second flange, wherein the second flange and the front side of the gutter may be secured in combination to a support of a framed enclosure. The gutter bracket may further have a brace member extending from a central portion of the arm member to the second flange. A generally planar splashguard extends along the front side of the gutter. The splashguard may include bottom flange carried at a bottom edge. The bottom flange may have a rib extending therefrom, wherein the rib mates with the channel in the top flange of the front side top edge of the gutter. The bottom flange of the splashguard may be secured to the top flange of the front side of the gutter. The splashguard may have a top flange extending along a top edge a channel for receiving a spline, and thus secure screening material the channel. Further, a splashguard bracket may be secured between the arm member of the gutter bracket and the splashguard proximate its top edge.

A method aspect may include a method for deflecting water from a tilted building roof away from a screened area adjacent the building. The method may comprise coupling a splashguard to the screened area and a gutter of a building, including coupling a first end to screen material of the screened area, and coupling a second end to a first side of a gutter of the building, coupling a gutter bracket positioned within the gutter of the building to the gutter, including coupling a first end to the first side of the gutter and coupling a second end to the second side of the gutter, and coupling a splashguard bracket to the splashguard and the gutter bracket, including coupling a first end to the first end of the splashguard and coupling a second end to the second end of the gutter bracket.

BRIEF DESCRIPTION OF THE DRAWINGS

For a fuller understanding of the invention, reference is made to the following detailed description, taken in connection with the accompanying drawings illustrating embodiments of the present invention, in which.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
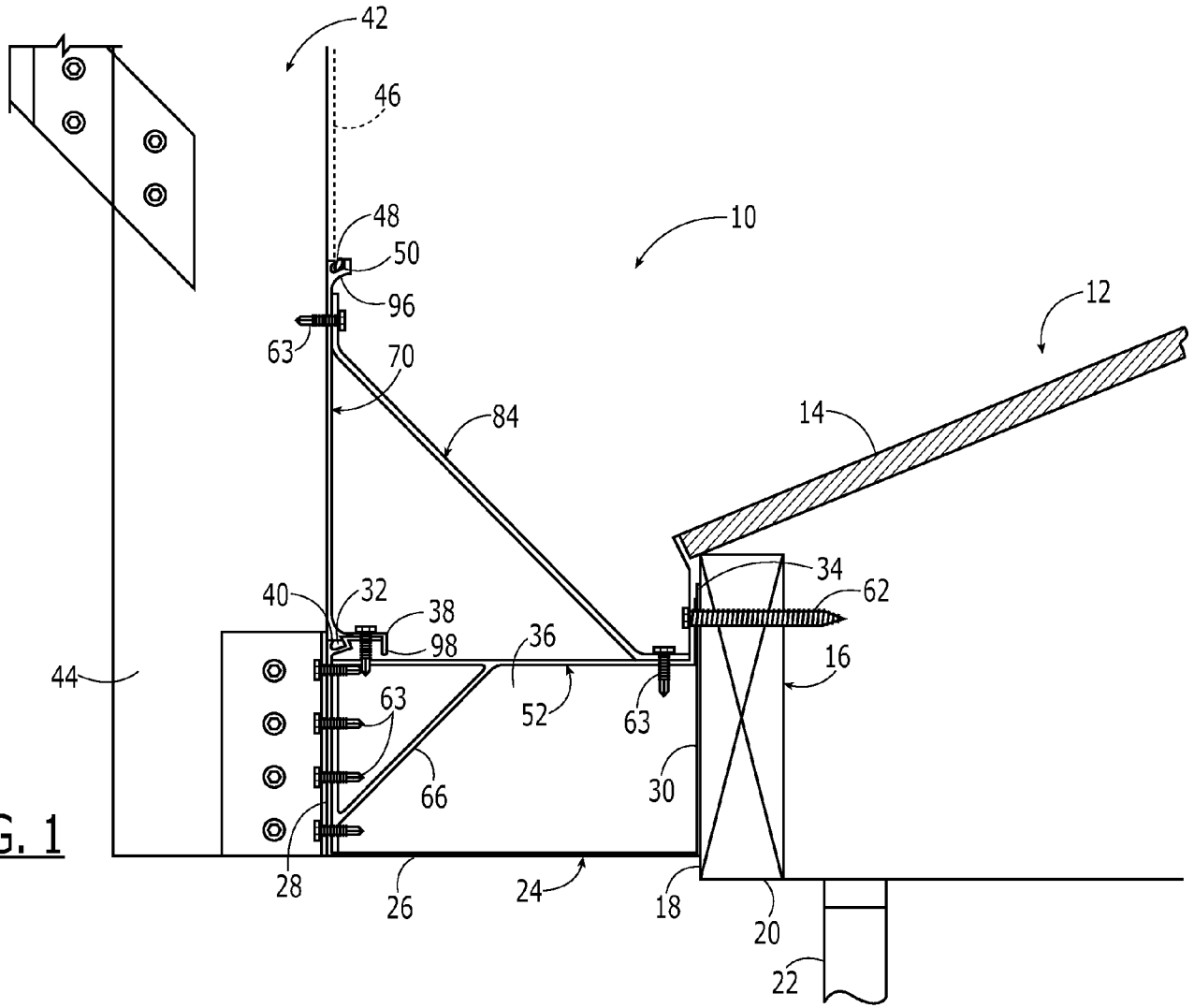
FIG. 1 is a partial diagrammatical cross section view illustrating one embodiment of the present invention.

Referring initially to FIG. 1, a roof gutter and framed screen enclosure system 10 in keeping with the teachings of the present invention is herein described, by way of example, as including a building structure 12 having a roof 14 and a support structure 16, as is well known to include a fascia 18, soffit 20, and vertical wall 22. A gutter is positioned for collecting water flowing from a surface of the roof 14, as is well known in roof guttering. For one embodiment of the invention, the gutter 24 is herein described as having a bottom 26 and opposing front and rear sides 28, 30 extending upwardly from the bottom to top edges 32, 34 thus forming a trough 36. With continued reference to FIG. 1 and to FIG. 2, the top edge 32 of the front side 28 of the gutter 24 includes a top flange 38 extending along the top edge, as illustrated with reference to FIG. 3. The top flange 38 includes a channel 40 extending along the top edge 32.

With reference again to FIG. 1, a framed enclosure 42 includes an upright support 44, wherein a screen material 46 is secured to the framed enclosure. A peripheral portion 48 of the screen material 46 includes a spline 50, or alternate edging well known to those skilled in the art.

With reference again to FIG. 2, by way of example, a gutter bracket 52 is positioned entirely within the trough 36. The gutter bracket 52 includes an arm member 54 having opposing first and second ends 56, 58. The first end 56 has a first flange 60 that is coupled to the rear side 30 of the gutter 24 using, by way of example, a lag screw 62, as illustrated with reference aging to FIG. 1. As will come to the mind of those skilled in the art, alternate fastening means may be used now having the benefit of the teachings of the present invention. As illustrated, the rear side 30 of the gutter 24 and the first flange 60 are secured in combination to the support structure 16. The second end 58 includes a second flange 64. The second flange 64 and the front side 28 of the gutter 24 are secured in combination to the upright support 44. As illustrated with continued reference to FIG. 2 and again to FIG. 3, the gutter bracket 52 further includes a brace member 66 extending from a central portion 68 of the arm member 54 to the second flange 64.

Figure 2:
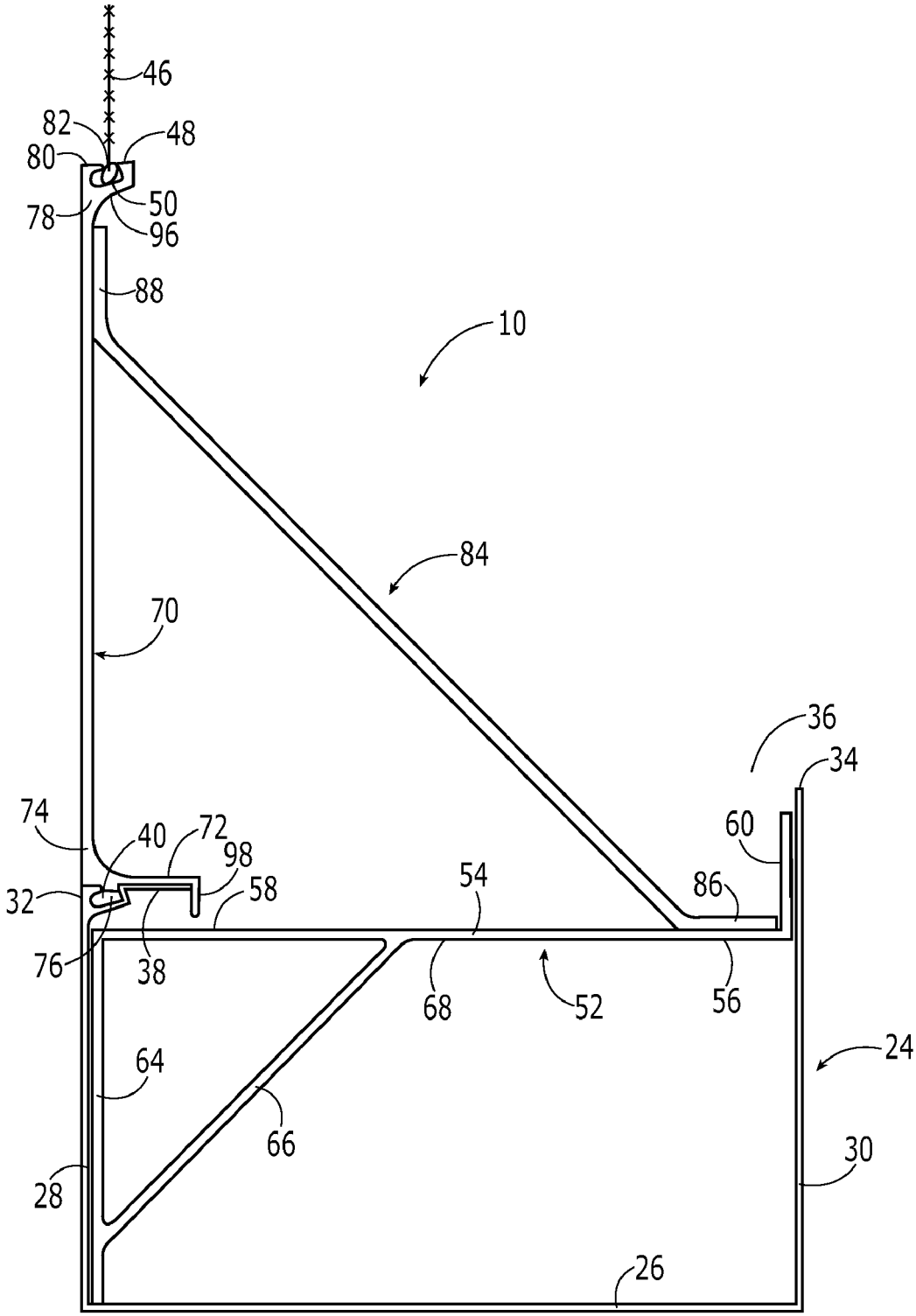
FIG. 2 is a partial side view illustrating element of a system described with reference to FIG. 1.
Figure 3:
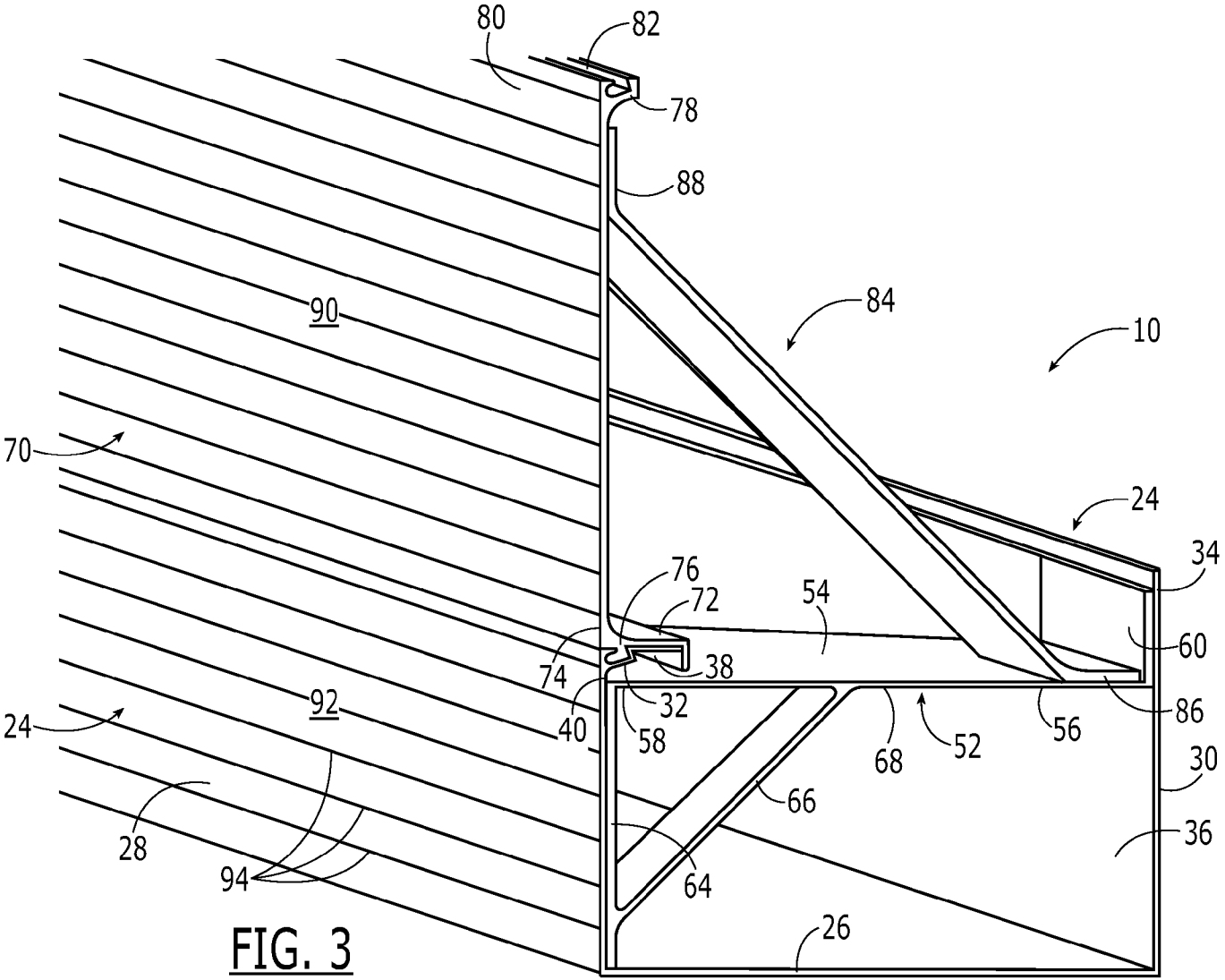
FIG. 3 is a perspective view of the embodiment of FIG. 2.

With continued reference to FIGS. 1-3, the system 10 further includes a generally planar splashguard 70 extending along the front side 28 of the gutter 24. The splashguard 70 is herein described as including a bottom flange 72 carried at a bottom edge 74 of the splashguard. The bottom flange 74 includes a rib 76 extending from the flange for mating with the channel 40 in the top flange 38 of the front side top edge 32 of the gutter 24. The bottom flange 72 of the splashguard 70 is secured to the top flange 38 of the front side 28 of the gutter 24. The splashguard 70 has a top flange 78 extending along its top edge 80, which top flange 78 includes a channel 82. The spline 50, and thus the screen material 46 is secured within the channel. A splashguard bracket 84 has a first end 86 secured to arm member 54 of the gutter bracket 52 and a second end 88 secured to the splashguard 70 proximate its top edge 80.

With reference again to FIG. 1, by way of example, the splashguard 70 thus provides a barrier for fast moving water coming off the roof 14 of the structure 12 and diverts the water into a structurally enhanced gutter 24 using the gutter bracket 52. With such a structurally enhanced gutter 24, the upright support 44 for the framed enclosure 42 may be attached noting the upright support 44 need not be extended to the ground.

By way of example, the splashguard 70 may be comprised of the aluminum alloy 6063-T6 that is extruded through a die. Specific structural specifications and shapes may be integrated into the splashguard that the typical "breaking" of aluminum does not accommodate. A front face 90 of the splashguard 70 and a front face 92 of the front side 28 of the gutter 24 may include a single or plurality of ribs 94, as illustrated with reference again to FIG. 3. The ribs 94 may be provided along the faces 90, 92 of the splashguard 70 that are intended to match the appearance of the face of gutter 24 and may be added for increased strength.

As illustrated with reference again to FIGS. 1-3, the top edge 80 of the splashguard includes the channel 82 useful as a spline groove that allows for the attachment of the screen material 46. For the system 10 including the splashguard 70 herein described, attachment of the splashguard may be after the screen material 46 has been installed. An area between the splashguard and the screen material may collect debris. Additional framework may be attached to the screening for preventing the debris from having a collection area. The channel 82 atop the splashguard 70 increases ease of installation by eliminating the need for additional framework.

As illustrated with reference to FIG. 1, a radius 96 of 0.375 inches is set below the channel 82 and on an inside corner towards its bottom for providing additional strength. As above described, the bottom edge 74 of the splashguard 70 (a "seat") may set atop the top flange 38 of a structural aluminum gutter 24 (a "super gutter"). The small protrusion or rib 76 at the seat serves to sit inside the channel 40 of the super gutter 24. The rear of the seat has a down turned lip 98 that may extend 0.25 inches. This lip 98 prevents water from getting between the top of the gutter 24 and the splashguard 70. The splashguard 70, as illustrated with reference again to FIG. 1, may be attached to the gutter 24 by fastening the splashguard to the gutter with a lag screw or sheet metal screw 63. It will also attach to each vertical framing member from the aluminum structure.

The structural components of the adjacent aluminum structure will attach to the face of the splashguard in a similar manner as they would attach to the face of the super gutter. The splashguard 70 may be extruded through a die to form a preselected cross sectional shape.

By way of example, for the embodiment illustrated with reference again to FIG. 1, a desirable resistance to uplift on a pool enclosure such as the framed enclosure 42 that attaches directly to the gutter 24 is provided. A more "positive connection" is also provided where a pool enclosure attaches to a host structure, such as the support structure 16

One embodiment may include a gutter bracket comprised of aluminum alloy 6063-T6 and extruded through a die process at desirable lengths. Two parallel flanges (opposed at 180 degrees from each other) may be separated by flat webbing. As above described, the brace member 66, a knee brace, is placed in a location along the backside of the second flange 64 in order for there to be a maximum allowable space for fasteners 63 to penetrate the face of the flange without penetrating into the knee brace. This knee brace may be an integral part of the gutter bracket. As a result various applied forces from the aluminum structure through the super gutter and ultimately back to the host structure itself.

As will come to the mind of those skilled in the art, now having the benefit of the teachings of the present invention, splashguard bracket 84 may or may not be needed in conjunction with the gutter bracket 52. Further, the splashguard bracket 84 may be attached to the splashguard 70 using a sheet metal screw 63, as illustrated with reference again to FIG. 1, and attach to the top of the gutter bracket 52 also by the use of a sheet metal screw 63. The bracket prevents the splashguard from bending and separating from its attachment point atop the super gutter when forces are applied to it from the framing components from the aluminum structure.

Many modifications and other embodiments of the invention will come to the mind of one skilled in the art having the benefit of the teachings presented in the foregoing descriptions and the associated drawings and photos. Therefore, it is to be understood that the invention is not to be limited to the specific embodiments disclosed, and that modifications and alternate embodiments are intended to be included within the scope of the claims supported by this specification.

That which is claimed is:

1. A roof gutter and framed screen enclosure system comprising:

a building structure having a roof surface and a support structure;

a gutter positioned for collecting water flowing from the roof surface, the gutter having a bottom and opposing front and rear sides extending upwardly from the bottom to top edges thereof thus forming a trough, wherein the top edge of the front side includes a top flange extending therealong, the top flange having a channel therein;

a framed enclosure having an upright support;

a screen material secured to the framed enclosure, wherein a peripheral portion of the screen material includes a spline;

a gutter bracket positioned entirely within the trough, the gutter bracket including an arm member having opposing first and second ends, the first end having a first flange coupled to the rear side of the gutter, wherein the rear side of the gutter and the first flange are secured in combination to the support structure, the second end including a second flange, wherein the second flange and the front side of the gutter are secured in combination to the upright support, the gutter bracket further having a brace member extending from a central portion of the arm member to the second flange; and a generally planar splashguard extending along the front side of the gutter, the splash guard having a bottom flange carried at a bottom edge thereof, the bottom flange having a rib extending therefrom, wherein the rib mates with the channel in the top flange of the front side top edge of the gutter, and wherein the bottom flange of the splash guard is secured to the top flange of the front side of the gutter, the splash guard having a top flange extending along a top edge thereof, the top flange having a channel, wherein the spline, and thus the screen is secured within the channel.

2. The system of claim 1, further comprising a splashguard bracket having a first end secured to the arm member of the gutter bracket and a second end secured to the splash guard proximate the top edge thereof.

3. The system of claim 1, wherein the splashguard is dimensioned for deflecting water flowing from the roof into the gutter.

4. The system of claim 1, wherein the bottom flange of the splashguard comprises a down-turned lip for contacting a top surface of the gutter bracket upon connecting the second end of the splashguard to the first side of the gutter.

5. The system of claim 1, wherein a front facing surface of the front side of the gutter and a front facing surface the splashguard each comprise regularly spaced ribs of substantially similar spacing.

6. The system of claim 1, wherein the first and second flanges of the gutter bracket are substantially parallel and at least one is substantially orthogonal to the arm member.

7. The system of claim 1, wherein the first flange of the gutter bracket couples to the rear side of the gutter by passing at least one fastener through at least one of the first flange of the gutter bracket, the rear side of the gutter, and the support structure of the building, and wherein the second flange of the gutter bracket couples to the front side of the gutter by passing at least one fastener through at least one of the second flange of the gutter bracket, the front side of the gutter, and the upright support.

8. The system of claim 7, wherein the brace member is positioned so as to facilitate passage of at least one fastener into the gutter.

9. The system of claim 2, wherein the first and second ends of the splashguard bracket respectively comprise flanged portions connected by an intermediate portion.

10. The system of claim 9, wherein the second end of the splashguard bracket aligns with the splashguard and the first end of the splashguard bracket aligns with the gutter bracket upon connecting the splashguard bracket to the splashguard and the gutter bracket.

11. The system of claim 10, wherein at least one fastener is passed through the second end of the splashguard bracket and the splashguard adjacent the first end of the splashguard, and wherein at least one fastener is passed through the first end of the splashguard bracket and the gutter bracket adjacent the first end of the gutter bracket.

12. A system comprising:

a gutter useful in collecting water flowing from a roof surface, the gutter having a bottom and opposing front and rear sides extending upwardly from the bottom to top edges thereof thus forming a trough, a gutter bracket positioned entirely within the trough, the gutter bracket including an arm member having opposing first and second ends, the first end having a first flange coupled to the rear side of the gutter, the second end including a second flange, wherein the second flange is secured to the front side of the gutter;

a splashguard extending along the front side of the gutter, the splashguard having a bottom edge secured to the front side of the gutter, the splash guard having a top flange extending along a top edge thereof, the top flange having a channel adapted to receive a spline and screen material within the channel; and a splashguard bracket having a first end secured to the arm member of the gutter bracket and a second end secured to the splash guard proximate the top edge thereof.

13. The system of claim 12, wherein the top edge of the front side of the gutter includes a top flange having a channel therein.

14. The system of claim 12, wherein the gutter bracket includes a brace member extending from a central portion of the arm member to the second flange.

15. The system according to claim 12, wherein the splashguard bottom and the front side of the gutter are joined in mating relation including a channel and a rib.

16. The system of claim 12, wherein the splashguard further comprises a flange having a down-turned lip contacting the front side of the gutter.

17. The system of claim 12, wherein a front facing surface of the front side of the gutter and a front facing surface of the splashguard each comprise a plurality of spaced apart ribs.

18. The system of claim 12, wherein the first and second flanges of the gutter bracket are substantially parallel and at least one substantially orthogonal to the arm member.

19. The system of claim 12, wherein the first flange of the gutter bracket couples to the rear side of the gutter by passing at least one fastener through at least one of the first flange of the gutter bracket and the rear side of the gutter, and wherein the second flange of the gutter bracket couples to the front side of the gutter by passing at least one fastener through at least one of the second flange of the gutter bracket and the front side of the gutter.

20. The system of claim 12, wherein the first and second ends of the splashguard bracket respectively comprise flanged portions connected by an intermediate portion.

21. The system of claim 20, wherein at least one fastener is passed through the second end of the splashguard bracket and the splashguard adjacent the first end of the splashguard, and wherein at least one fastener is passed through the first end of the splashguard bracket and the gutter bracket adjacent the first end of the gutter bracket.

22. A method for deflecting water from a tilted building roof away from a screened area adjacent the building, the method comprising:

coupling a splashguard to the screened area and a gutter of the building, including coupling a first end to a screen material of the screened area, and coupling a second end to a first side of the gutter of the building;

coupling a gutter bracket positioned within the gutter of the building to the gutter, including coupling a first end to a first side of the gutter and coupling a second end to a second side of the gutter, and coupling a splashguard bracket to the splashguard and the gutter bracket, including coupling a first end to the first end of the splashguard and coupling a second end to the second end of the gutter bracket.

23. The method of claim 22, wherein coupling a splashguard to the screened area and a gutter further comprises:

connecting the first end of the splashguard comprising a spline groove to the screen material of the screened area; and receiving the second end of the splashguard comprising a protrusion within the first side of the gutter comprising an opening thereby connecting the second end of the splashguard to the first side of the gutter.

24. The method of claim 22, wherein the second end of the splashguard further comprises a down-turned lip for contacting a top surface of the gutter bracket upon connecting the second end of the splashguard to the first side of the gutter.

25. The method of claim 23, wherein the first end of the splashguard further comprises a lower surface opposite an upper surface including the spline groove, the lower surface having a radius of curvature.

26. The method of claim 22, wherein the first and second ends of the gutter bracket respectively comprise substantially parallel first and second flanges separated by at least one substantially orthogonal link.

27. The method of claim 22, wherein coupling the splashguard bracket to the first end of the splashguard and the second end of the gutter bracket further comprises aligning the first and second ends of the splashguard bracket along the respective splashguard and the gutter bracket in substantial orthogonal directions upon connecting the splashguard bracket to the splashguard and the gutter bracket.

28. A system comprising:

a gutter useful in collecting water flowing from a roof surface, the gutter having a bottom and opposing front and rear sides extending upwardly from the bottom to top edges thereof thus forming a trough, a gutter bracket positioned entirely within the trough, the gutter bracket including an arm member having opposing first and second ends, the first end having a first flange coupled to the rear side of the gutter, the second end including a second flange, wherein the second flange is secured to the front side of the gutter;

a splashguard extending along the front side of the gutter, the splashguard having a bottom edge secured to the front side of the gutter, the splash guard having a top flange extending along a top edge thereof, the top flange having a channel adapted to receive a spline and screen material within the channel; and wherein the splashguard bottom and the front side of the gutter are joined in mating relation including a channel and a rib.

* * * * *